US007506463B2

(12) United States Patent
Holst

(10) Patent No.: US 7,506,463 B2
(45) Date of Patent: Mar. 24, 2009

(54) UNIVERSAL ELECTRONIC GAMING MACHINE TOPPER SIGN

(75) Inventor: Barrie James Holst, Baulkham Hills (AU)

(73) Assignee: The Bright Group Pty Limited, New South Wales (AU)

( * ) Notice: Subject to any disclaimer, the term of this patent is extended or adjusted under 35 U.S.C. 154(b) by 385 days.

(21) Appl. No.: 11/378,915

(22) Filed: Mar. 17, 2006

(65) Prior Publication Data

US 2007/0113442 A1 May 24, 2007

(30) Foreign Application Priority Data

Aug. 10, 2005 (AU) ..... 2005904311

(51) Int. Cl.
*G09F 13/26* (2006.01)

(52) U.S. Cl. ..... 40/545; 40/550; 362/812

(58) Field of Classification Search ..... 40/545, 40/550, 558, 564, 574
See application file for complete search history.

(56) References Cited

U.S. PATENT DOCUMENTS 5,270,910 A * 12/1993 Kile ..... 362/216
5,617,659 A * 4/1997 Okubo ..... 40/545
5,664,352 A * 9/1997 Beckman ..... 40/545
5,946,839 A * 9/1999 Odmark ..... 40/642.01
5,966,856 A * 10/1999 Alu ..... 40/564
7,024,808 B2 * 4/2006 Chiang ..... 40/545
2004/0266524 A1 12/2004 Wiliams

FOREIGN PATENT DOCUMENTS

AU 2005 220 258 8/2006
JP 09006260 A * 1/1997

* cited by examiner

*Primary Examiner*—Cassandra Davis
(74) *Attorney, Agent, or Firm*—Abelman, Frayne & Schwab

(57) ABSTRACT

A universal gaming machine topper sign (10) has a body portion (11), having a back wall (15), a side wall (16), an open front face (17) and a mounting base (18), a reflector carrier (13) mounted on the base (18) of the body portion (11), a cold cathode lamp (14) mounted in front of the reflector carrier (13), an annular printed circuit board (50) having illumination means (52) around its periphery which are mounted on the periphery of the reflector carrier (13) and a door (12) for closing the front face (17) of the body portion (11), the door (12) having an annular body portion (30) having light apertures (35) and a central portion (37) for receiving a display panel (51), the light apertures (35) of the door (12) being in alignment with the illumination means (52) mounted around the printed circuit board (50).

9 Claims, 6 Drawing Sheets

UNIVERSAL ELECTRONIC GAMING MACHINE TOPPER SIGN

BACKGROUND OF THE INVENTION

1. Field of the Invention

This invention relates to display panels and more particularly to a universal topper sign for displaying information and/or advertisements on the top of electronic gaming machines.

2. Description of the Related Art

Toppers for gaming machines usually carry some message regarding the game installed in the machine to which the topper is attached—for example, MYSTERY JACKPOT.

There is a need for a universal topper sign for a gaming machine which is easy to assemble, provides appropriate illumination and enables the displayed message to be changed without difficulty.

According to one aspect of the invention there is provided a universal topper sign for a gaming machine comprising a body portion having a back wall, a side wall, an open front and a mounting base, a reflector carrier mounted on the base of the body portion, a cold cathode lamp mounted in front of the reflector carrier, an annular printed circuit board having illumination means around its periphery which are mounted on the periphery of the reflector carrier and a door for closing the front face of the body portion, the door having an annular body portion having light apertures and a central portion for receiving a display panel, the light apertures of the door being in alignment with the illumination means mounted around the printed circuit board.

BRIEF DESCRIPTION OF THE DRAWINGS

In order that the invention may be more readily understood and put into practical effect, reference will now be made to the accompanying drawings in which.

DETAILED DESCRIPTION OF THE PREFERRED EMBODIMENTS

Figure 1:
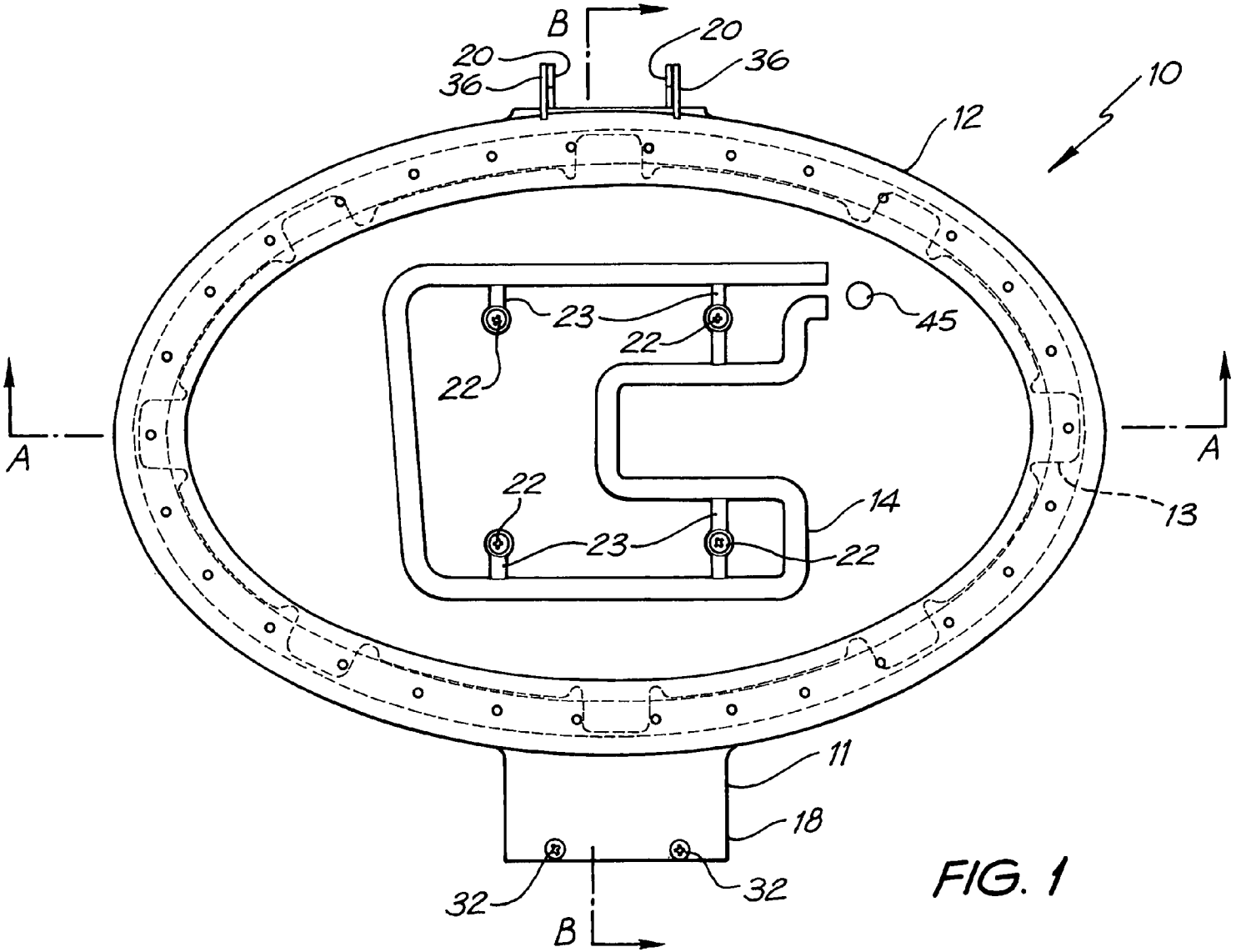
FIG. 1 is a front elevational view of a universal topper sign according to one embodiment of the invention.
Figure 3:
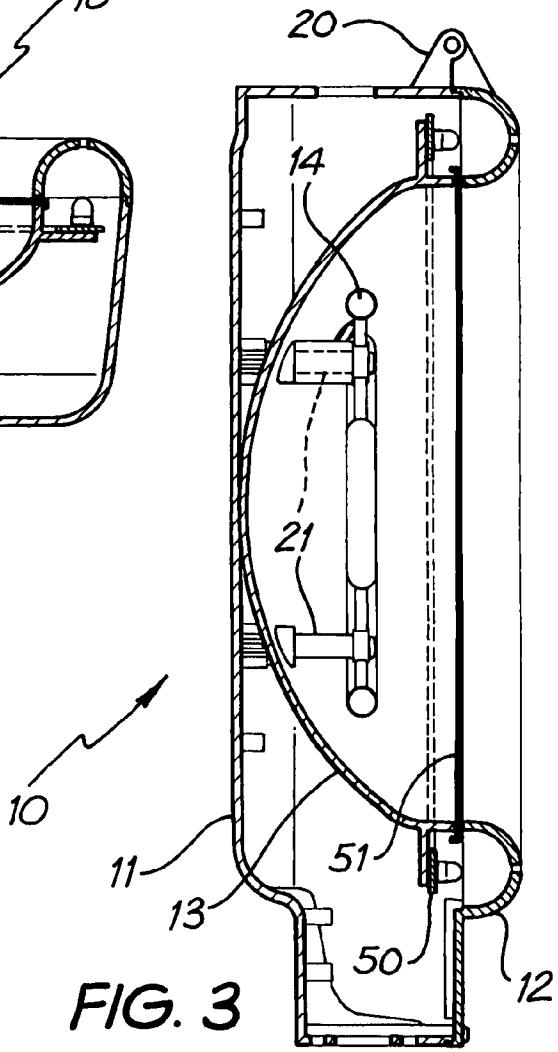
FIG. 3 is a cross sectional view taken along lines B-B of FIG. 1.
Figure 2:
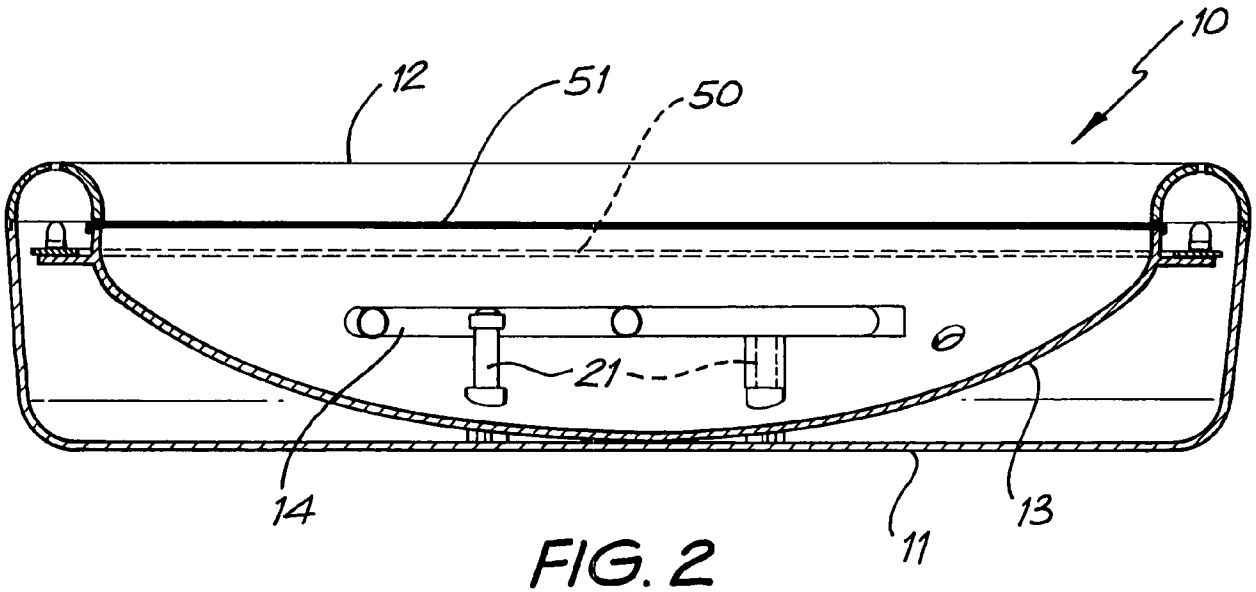
FIG. 2 is a cross sectional view taken along lines A-A of FIG. 1.
Figure 4:
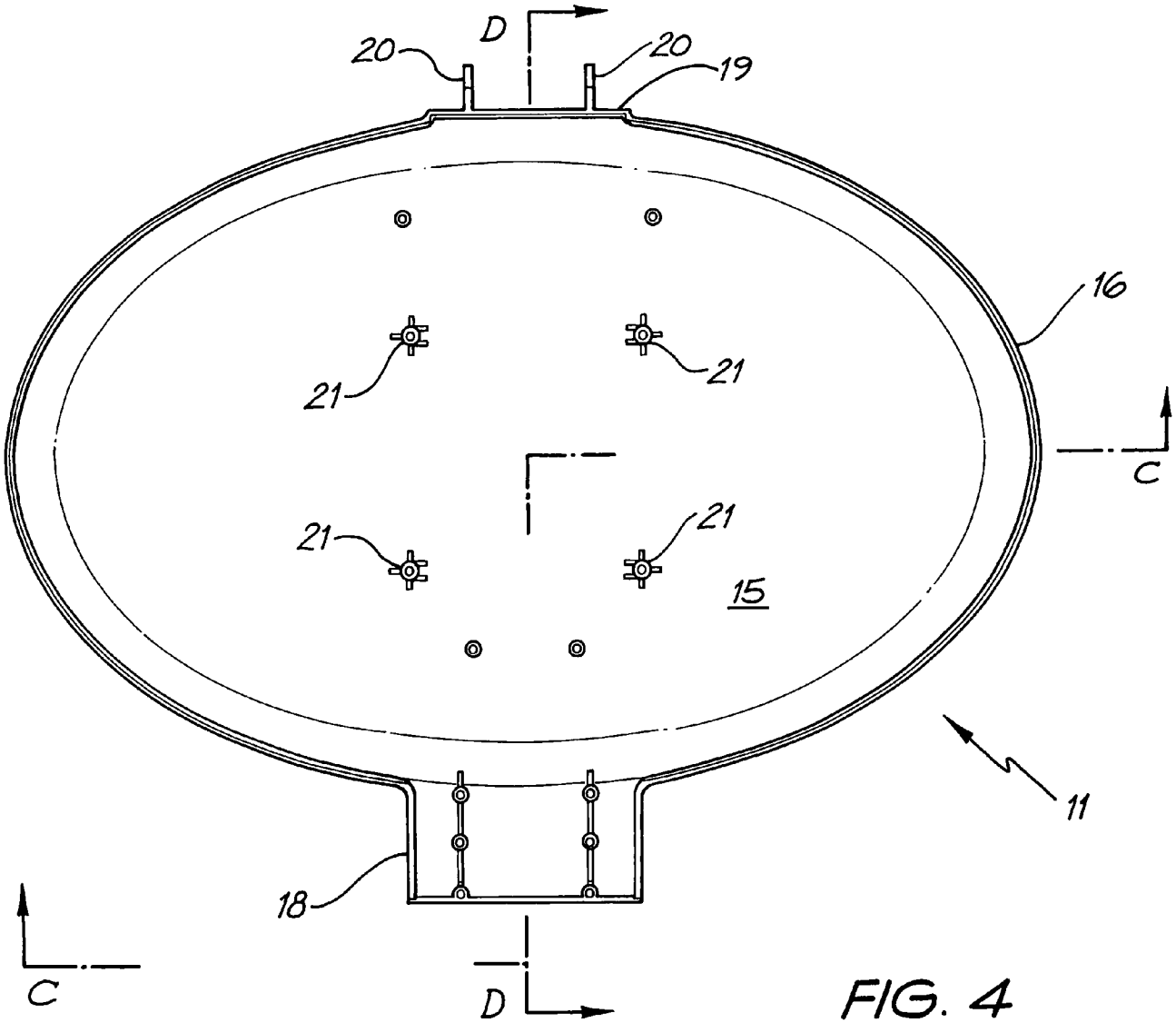
FIG. 4 is a front elevational view of the body portion of the universal topper sign shown in FIG. 1.
Figure 7:
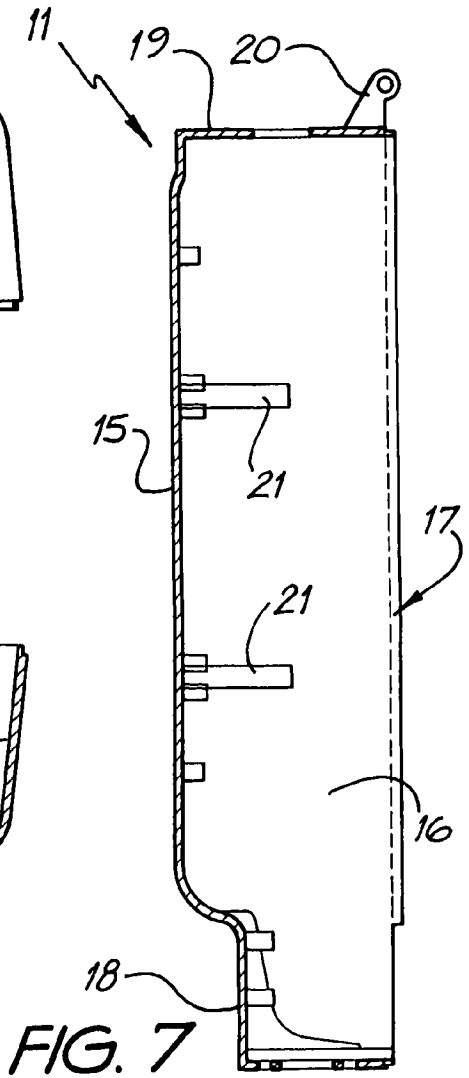
FIG. 7 is a view taken along lines D-D of FIG. 4.
Figure 5:
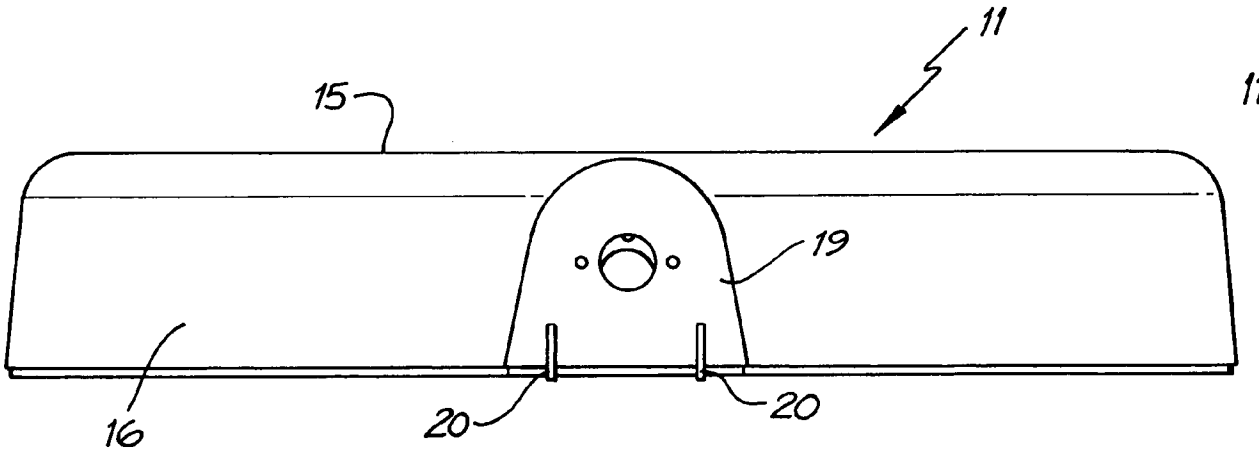
FIG. 5 is a plan view from below of the body portion shown in FIG. 4.
Figure 6:
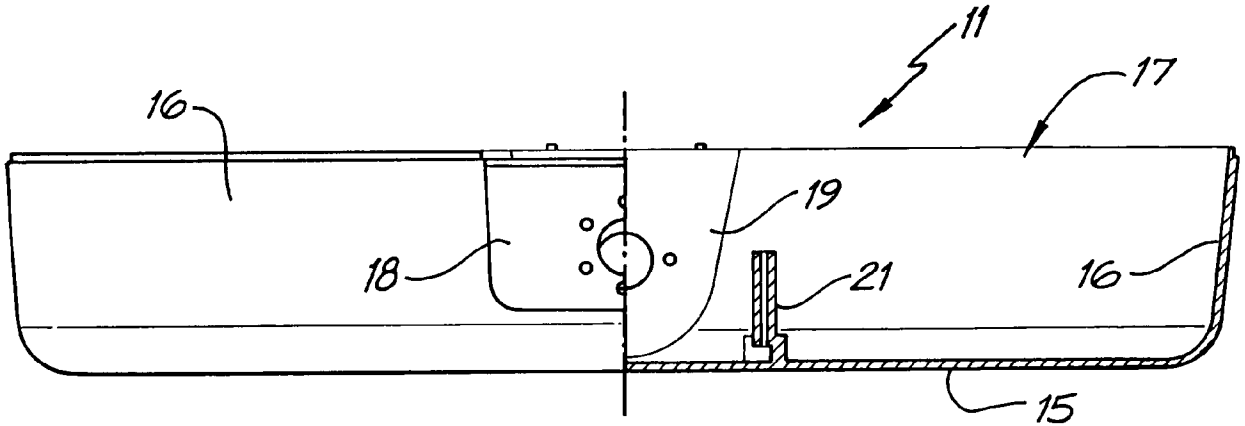
FIG. 6 is a view taken along lines C-C of FIG. 4.

The universal topper sign 10 shown in the drawings comprises a body portion 11, a door 12, a reflector carrier 13, a cold cathode lamp 14, a printed circuit board 50 and a sign 51.

The body portion 11 has a back wall 15, side wall 16, an open front 17, a mounting base 18 and a hinge mounting 19 having hinge lugs 20. Upstanding from the back wall 15 are four bosses 21 each of which has a threaded interior for receiving a fastener 22 that passes through each of the mounting lugs 23 on the cold cathode lamp 14.

Figure 9:
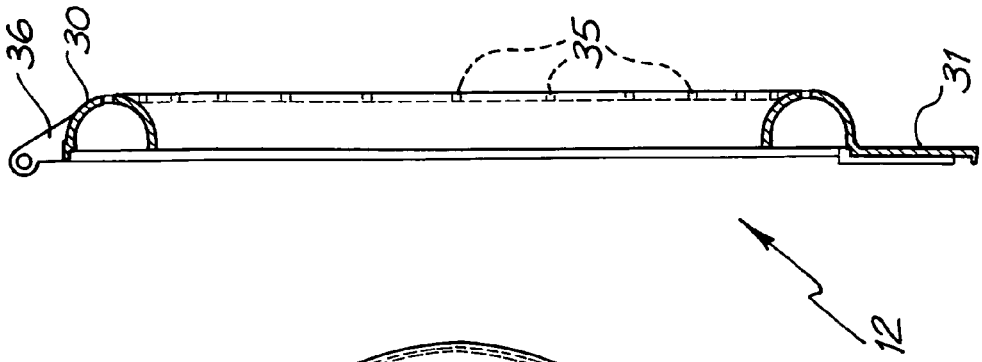
FIG. 9 is a cross sectional view taken along lines E-E of FIG. 8.
Figure 8:
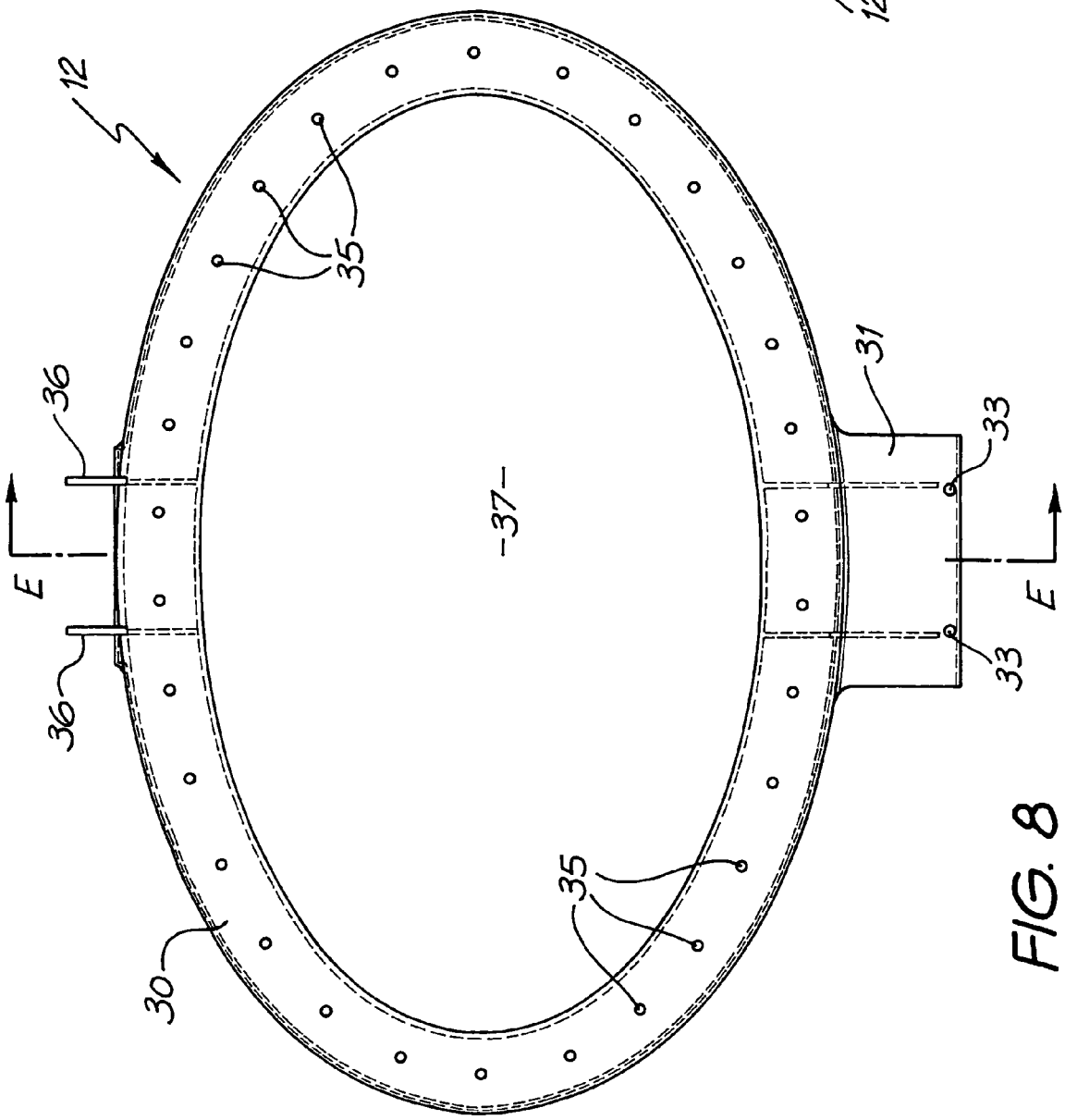
FIG. 8 is a front elevational view of the door shown in FIG. 1.

The door 12 which is shown in detail in FIGS. 8 and 9 has a domed, elliptically shaped annular portion 30 around its periphery which has a front flap 31 that overlies the open face of the base 18 and is secured thereto by fasteners 32 (see FIG. 1) that pass through apertures 33 into bosses 34 formed in the base 18. Around the annular periphery 30 of the door 12 there is an array of light apertures 35. Hinge lugs 36 are pinned to the hinge lugs 30 on the body portion 11. The central portion 37 is open to provide visual access to a clip-end display panel or sign 51.

Figure 12:
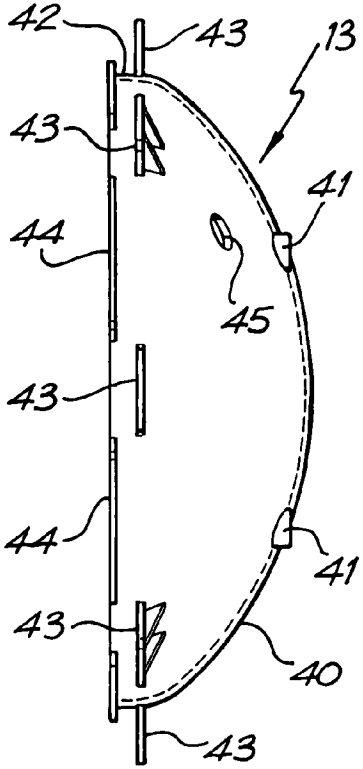
FIG. 12 is an end view of the reflector carrier shown in FIG. 10.
Figure 10:
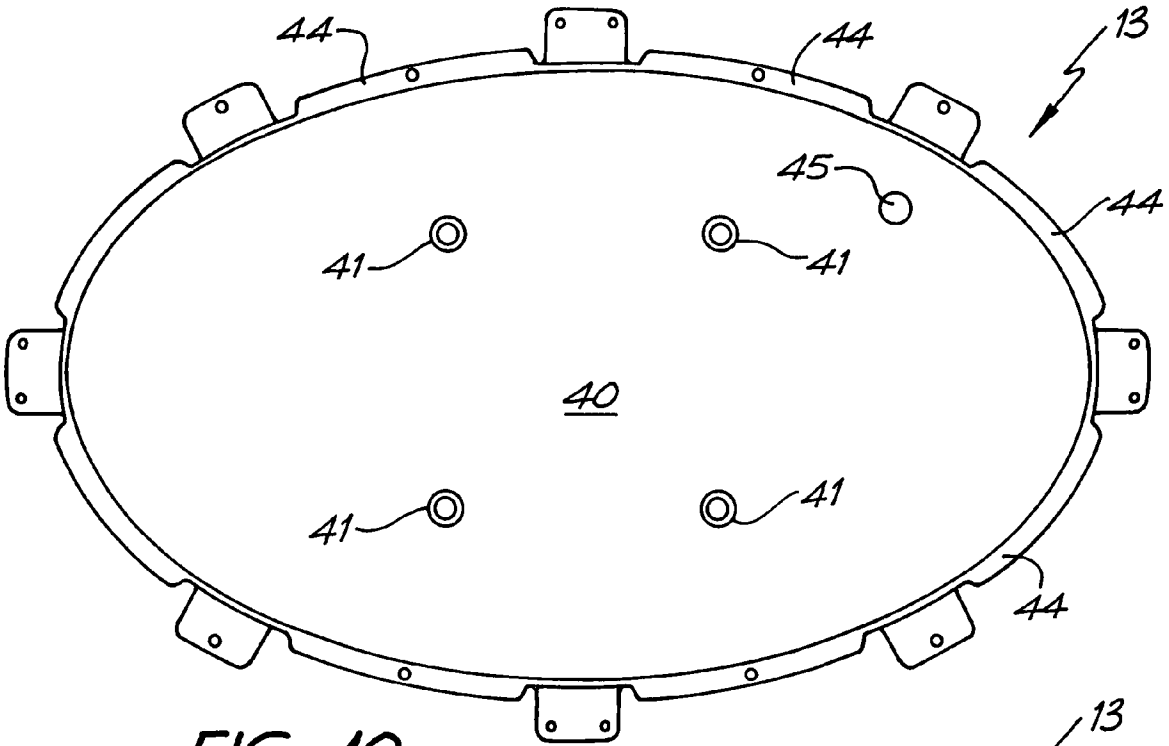
FIG. 10 is a front elevational view of the reflector carrier shown in FIG. 1.
Figure 11:
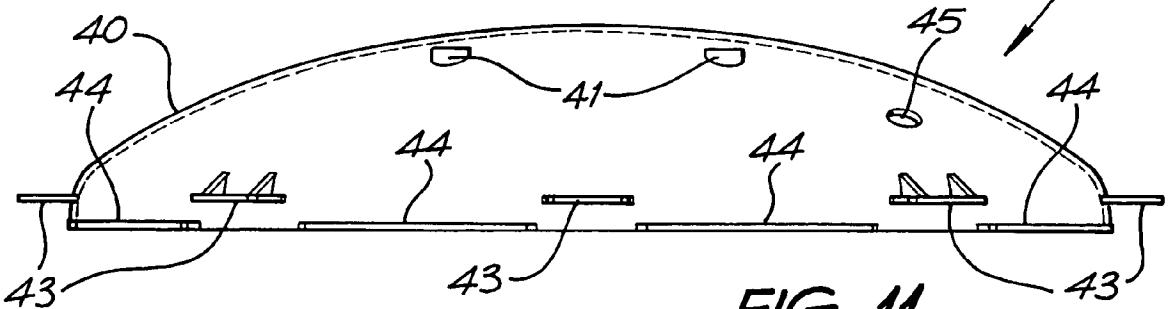
FIG. 11 is a top view of the reflector carrier shown in FIG. 10.

The reflector carrier 13 which is shown in detail in FIGS. 10 to 12 has a domed base 40 having apertures 41 through which the cold cathode lamp fasteners 22 pass. Around the periphery 42 of the reflector carrier 13 there is a plurality of tabs 43 which support a printed circuit board 50 having illumination means 52 around its periphery (see FIG. 1). In between the tabs 43 there are mounting portions 44 to which the sign 51 is attached. Aperture 45 in the reflector carrier 13 provides access for an electric power lead to the cold cathode lamp 14.

The universal topper sign of the invention may be injection moulded from lightweight high impact polymers. The illumination means 52 may be light emitting diodes and the basic shape and colour of the topper sign, the light shapes and sequencing displays may be varied as required.

Preferably, the universal topper sign incorporates fully solid state LED lighting and cold cathode fluorescent lamps. The hinge mounting 19 may be adapted to support a light tower.

The door 12 lifts to an over centre attention position to allow unrestricted access to the interior of the sign with all operational components being easily accessible from the front of the universal topper sign.

The LED light sequencing can be manually selected and held as required, or altered via a communications link to control all or selected adjacent Uni-topper signs operating in a common promotional scheme. There are a possible 40 or more LED light sequences available for selection as desired for association with various game themes.

A light guide may be used in conjunction with the surface mounted high intensity LED, this effectively takes the high intensity light produced by the LED and raises it above the top outer surface of the door frame so that it can be seen from all viewing angles.

The light guide can also be fitted with various end caps which protrude above the outer round surface of the door to produce various illuminated shapes, Stars, Dots, Dollar Signs, Horse Shoes, Hearts, Diamonds, Coins, Gold Bars, Lightning Bolts, Crosses, etc, as associated with gaming machines and their various game themes.

The end cap that is clipped over the protruding end of the light tube can be clear, white or coloured as required to fit in association with the particular game theme of the gaming machine and can be changed at will to be associated with possible future theme changes of the gaming machine as may be implemented on the casino floor.

The front door 12 may be moulded in a white translucent polymer with holes for light guides, and in this instance it uses an LED Array (formed in 4× quadrants to fit the oval shape of the topper door) and presents the same lighting effects combined with communications linking to co-ordinate associated adjacent toppers.

The lighting effects of the LED which would normally be seen as a dot are diffused by the round section of the front door to present as a light column on the outer rounded surface of the door and visible from all front angles.

Various modifications may be made in details of design and construction without departing from the scope and ambit of the invention.

The invention claimed is:

1. A universal gaming machine topper sign comprising a body portion having a back wall, a side wall, an open front and a mounting base, a reflector carrier mounted on the body portion, a cold cathode lamp mounted in front of the reflector carrier, an annular printed circuit board having illumination means around its periphery which are mounted on the periphery of the reflector carrier and a door for closing the open front of the body portion, the door having an annular body portion having light apertures and a central portion for receiving a display panel, the light apertures of the door being in alignment with the illumination means mounted around the printed circuit board.

2. A topper sign according to claim 1 wherein the body portion has a hinge mounting having hinge lugs and the door has hinge lugs engaged with the hinge lugs of the body portion.

3. A topper sign according to claim 2 wherein the hinge mounting is at the top of the body portion.

4. A topper sign according to claim 1 wherein the door is moulded in a white translucent polymer.

5. A topper sign according to claim 1 wherein the door has a domed elliptically shaped annular position around its periphery which has a front flap that overlies an open face of the base.

6. A topper sign according to claim 1 wherein the reflector carrier has a domed base having apertures for receiving fasteners of the cold cathode lamp.

7. A topper sign according to claim 1 wherein the body portion is injection moulded from a lightweight high impact polymer.

8. A topper sign according to claim 1 wherein the illumination means comprises light emitting diodes.

9. A universal gaming machine topper sign comprising a body portion having a back wall, a side wall, an open front and a mounting base of a reflector carrier mounted on the body portion, the body portion having hinge lugs, a cold cathode lamp mounted in front of the reflector carrier, an annular printed circuit board having illumination means around its periphery which are mounted on the periphery of the reflector carrier, and a door for closing the front face of the body portion, the door being moulded in white translucent polymer and having hinge lugs engaged with the hinge lugs of the body portion, the door having annular body portion having light apertures and a central portion for receiving a display panel, the light apertures of the door being in alignment with the illumination means mounted around the printed circuit board.

* * * * *